US006330801B1

(12) United States Patent
Whelan et al.

(10) Patent No.: US 6,330,801 B1
(45) Date of Patent: Dec. 18, 2001

(54) METHOD AND SYSTEM FOR INCREASING CRYOPUMP CAPACITY

(76) Inventors: Francis J. Whelan, 11704 Onion Hollow Run, Austin, TX (US) 78739; Keith E. Reidy, 83 DeBell Dr., Atherton, CA (US) 94027

( * ) Notice: Subject to any disclaimer, the term of this patent is extended or adjusted under 35 U.S.C. 154(b) by 0 days.

(21) Appl. No.: 09/592,181

(22) Filed: Jun. 12, 2000

Related U.S. Application Data

(60) Provisional application No. 60/138,700, filed on Jun. 11, 1999.

(51) Int. Cl.[7] ..... B01D 8/00
(52) U.S. Cl. ..... 62/55.5
(58) Field of Search ..... 62/55.5

(56) References Cited

U.S. PATENT DOCUMENTS

| | | | | |
|---|---|---|---|---|
| 3,488,978 | | 1/1970 | Della Porta et al. | 62/55.5 |
| 4,009,585 | | 3/1977 | Larin | 62/55.5 |
| 4,295,338 | | 10/1981 | Welch | 62/55.5 |
| 4,718,241 | | 1/1988 | Lessard et al. | 62/55.5 |
| 5,450,729 | | 9/1995 | Hilton | 62/55.5 |
| 5,477,692 | * | 12/1995 | Myneni et al. | 62/55.5 |
| 5,482,612 | | 1/1996 | Armstrong et al. | 204/298.11 |
| 5,855,118 | * | 1/1999 | Lorimer | 62/55.5 |
| 6,003,320 | * | 12/1999 | Okamura et al. | 62/6 |

FOREIGN PATENT DOCUMENTS

| | | |
|---|---|---|
| 1.564.955 | 3/1969 | (FR) . |
| 1106418 | 3/1968 | (GB) . |

OTHER PUBLICATIONS

Haefer, R.A., *Cryogenic vacuum techniques*, J. Phys. E: Sci. Instrum., vol. 14, 1981, p273–288.

* cited by examiner

*Primary Examiner*—William C. Doerrler
(74) *Attorney, Agent, or Firm*—Flehr Hohbach Test Albritton & Herbert LLP

(57) ABSTRACT

A cryopump in which the surface area of the condensing or adsorbing panels is increased without materially increasing the dimensions by applying a porous or roughened layer on the surface of the panels.

24 Claims, 4 Drawing Sheets

METHOD AND SYSTEM FOR INCREASING CRYOPUMP CAPACITY

PRIORITY APPLICATION

This application claims priority to Provisional Application Serial No. 60/138,700 filed Jun. 11, 1999.

BRIEF DESCRIPTION OF THE INVENTION

The present invention relates to cryogenic vacuum pumps and more particularly to applied coatings for condensing and/or adsorbing gases in a cryogenic vacuum pump.

BACKGROUND OF THE INVENTION

Cryogenic pumps function by condensing and adsorbing gases on to very cold surfaces. The surfaces are typically cooled using a Helium gas refrigerator. A cryopump acts essentially as a gas freezer and storage device. Once the gas molecules are frozen onto the surface, they no longer exert pressure in the evacuated chamber. Once the surfaces are full or saturated, they must be regenerated to restore pumping performance.

Typically, cryopumps operate as two stage pumps. The first stage operates at a temperature around 80 degrees K with the intent to condense water vapor and carbon dioxide. The second stage operates at a lower temperature, typically 20 degrees K in order to condense other common gases such as oxygen, nitrogen, and argon. The second stage also normally includes an activated charcoal charge which acts to adsorb Helium and Hydrogen.

The mechanism by which gas molecules arrive at the pumping surface and are condensed or adsorbed is complicated. The gas molecule itself has many interactions with the pumping surface. First, the gas molecule must attach itself to the surface in a process called adsorption. Adsorption can only occur after the molecule has lost sufficient energy that it can be held on the surface by weak forces called Van Der Waals forces. These forces are very weak and a molecule must attain a low energy state for this to occur. One way for molecules to lose energy is through collisions. Inelastic collisions are those where molecules lose energy by transferring it to other molecules when they hit. A gas molecule that enters the pump may collide with the pumping surface and simply bounce off. A gas molecule may bounce many times before it has lost sufficient energy to adsorb to the pumping surface. Each time that a molecule bounces, there is a chance that it will be directed back out of the pump into the evacuated space. Because cryopumping depends upon the random motion of gases, keeping gas molecules inside of the pump is of prime interest.

Whether or not the molecule bounces depends on many factors. These include the atom's or molecule's energy level, its kinetic energy, angle of incidence, surface profile, and surface temperature.

A typical two-step cryogenic pump 11 is shown in FIG. 1. The pump includes an outer vacuum vessel 12 having a cylindrical opening at one end circumscribed by a mounting flange 13. Flange 13 includes bores 14 for securance of the same in accordance with standard practice via a gate valve or the like to a vacuum chamber to be pumped. Vessel 12 houses a conventional refrigeration cylinder 16 axially within the same. Such cylinder supports and provides the desired low temperatures to the first and second stages of the pump. In this connection, in accordance with conventional practice the cylinder 16 relies on the condensation of helium to obtain the low temperatures. A compressor (not shown) supplies room temperature helium under pressure to the pump via connection 17, where the helium expands to cool the two stages of the pump.

The first, or initial stage of the pump is made up of a radiation shield 18 which supports an array 21 of coaxial annular fins. The array 21 provides the dual function of acting not only to provide an extended surface area for condensation at the initial stage, but also to protect the lower temperature condensation and adsorbent second stage from direct line-of-sight exposure to the gases to be pumped. With respect to the former, such array is constructed to provide overlapping surface areas which block such line-of-sight but yet permit passage therethrough of those gases which do not condense on its surface areas. It is thermally coupled via the radiation shield 18 to the central area of the cylinder 16 so as to be maintained at a temperature within the range of 50°–80° K. A washer 22 made of a good thermally conductive material such as indium is provided at the physical connection of the shield to the cylinder 16 to assure good thermal conduction between the two.

The second stage of the pump includes an array of condensing panels or plates 23. In the prior art a portion of these panels is generally covered with a coating of adsorbent material such as activated charcoal. The coating is applied to the surface with an adhesive. The adhesive is applied in such a manner that the adsorbent particles are exposed. In U.S. Pat. No. 5,450,729, the coating material is applied with an adhesive which is transparent to passage of the gases which are being pumped.

The second stage usually operates at a temperature between 10–20 degrees K. On to these panels gases such as nitrogen, oxygen, and argon adhere. Gases that are not condensed onto a second stage panel can lastly be adsorbed into the activated charcoal adhering to the second stage array as described above.

In order to pump and hold more gases, the pumping surface area can be increased. The common method of accomplishing this is to place more baffle plates into the pump. This increases the chance that gases can attach and condense. Doing this reduces the amount of open area between the baffle plates. This increased restriction makes it more difficult for gases to get to the other baffle plates in the array. The result is slower pumping speed. Cryopumping is a slow process to begin with, so any loss of pumping speed is undesirable.

Since a cryopump is essentially a storage device it must be periodically emptied. This is called regeneration. The process of regeneration involves shutting down the pump, warming it up, and circulating gas through it. It is much the same as defrosting a refrigerator. The amount of gas a cryopump can freeze depends upon the temperature and surface area of the arrays. As the pumping surfaces continue to accumulate frozen material, a temperature gradient begins to develop across the frozen layer. When there is sufficient thickness of material, the temperature gradient becomes so great that the pumping surface can no longer accumulate more gases. At this point, the pump stalls. An equilibrium is set up where gases are freezing as fast as they sublimate. Due to this equilibrium, no additional gases can be pumped. Before the point of stalling is reached, the pump performance steadily degrades. The only way to cope with this loss of performance is to regenerate the pump. Each manufacturer has specifications for the total recommended gas load that a pump can accommodate. Once this load has been reached, the pump must be regenerated. As the pump is being regenerated, the equipment that it is servicing cannot be used. If the capacity of the pump could be increased, less frequent regeneration would be required.

OBJECTS AND SUMMARY OF THE INVENTION

It is a general object of the present invention to provide an improved cryopump.

It is another object of the present invention to provide a cryopump in which the pumping speed and/or capacity is increased by increasing the available condensing surface area.

The foregoing and other objects of the invention are achieved by maximizing the surface area of existing baffle plates or adsorbing surfaces without changing their basic dimensions. The surface area can be increased by applying a porous or roughened coating to selected surfaces of the baffle plates or adsorbing surfaces.

BRIEF DESCRIPTION OF THE DRAWINGS

The foregoing and other objects of the invention will be more clearly understood from the following description when read in conjunction with the accompanying drawings in which.

DESCRIPTION OF THE PREFERRED EMBODIMENT

Figure 1:
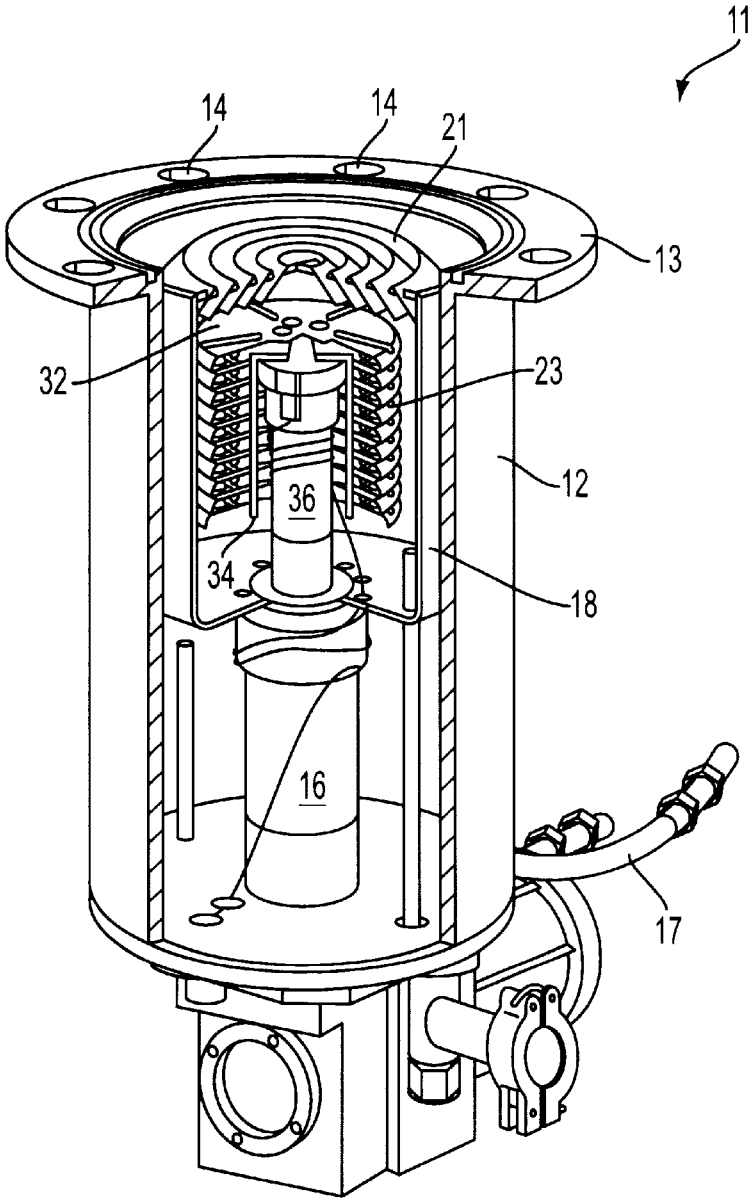
FIG. 1 is an isometric view of a two-stage cryopump incorporating the present invention.
Figure 2:
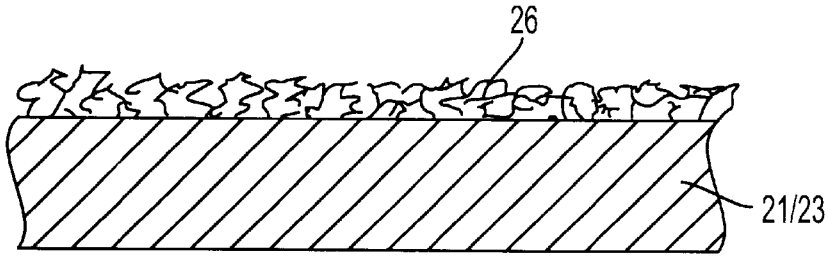
FIG. 2 is an enlarged sectional view illustrating in section a portion of a baffle plate with a porous metal film or coating.
Figure 3:
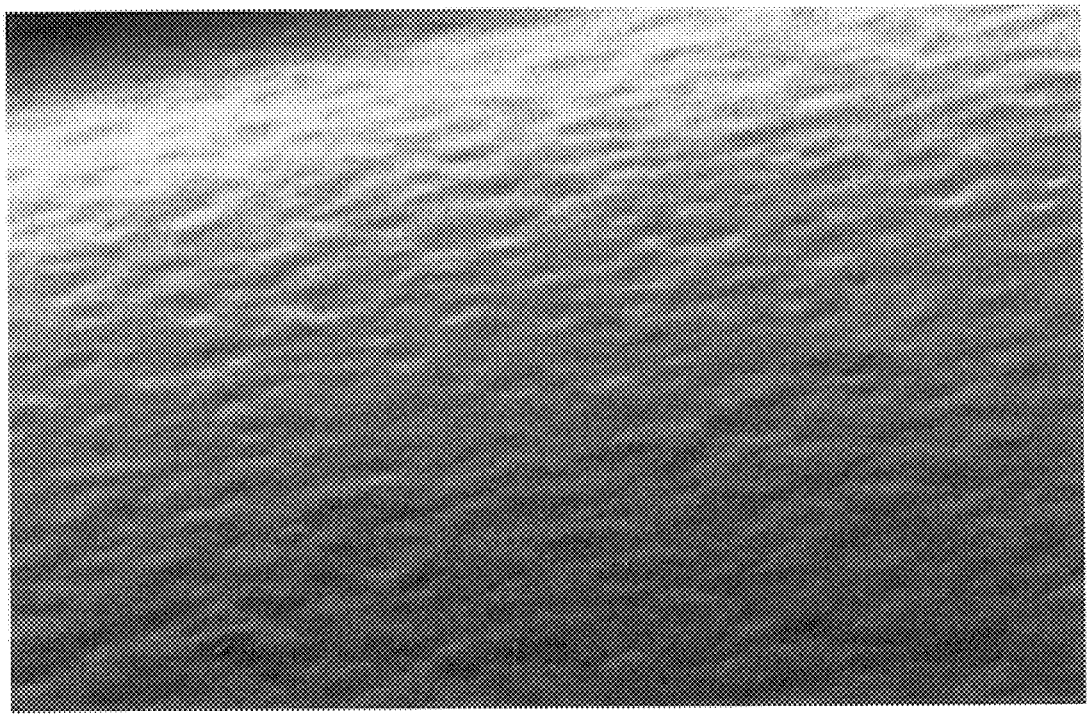
FIG. 3 is a scanning electron micrograph showing the surface of a conventional baffle or panel.
Figure 4:
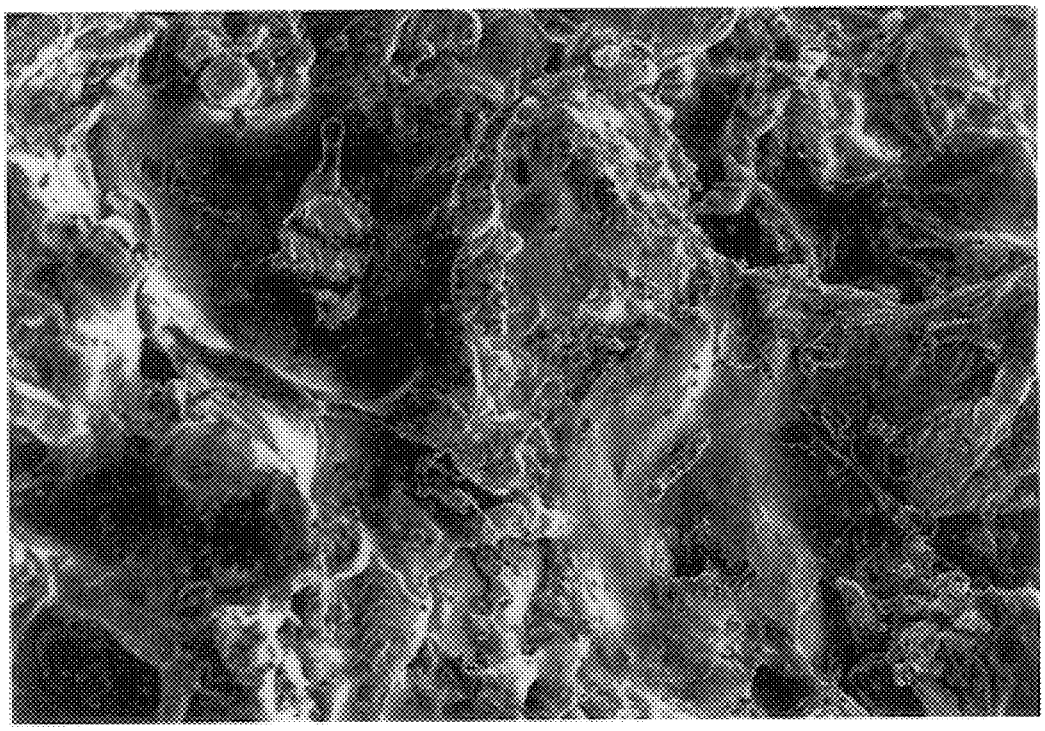
FIG. 4 is an scanning electron micrograph showing the surface of a baffle plate coated with an applied layer in accordance with the present invention.

In accordance with the present invention, at least a portion of the condensing panels 21, 23 and/or radiation shield 18 or other exposed interior surfaces is provided with a porous or roughened thermal conductive coating. FIG. 2 shows an enlarged sectional view of a portion of a panel or plate 21 or 23 with a coating, film or layer 26. The coating can be applied by flame spraying (powder and wire), plasma spraying, high velocity oxy-fuel (HVOF) or twin wire arc spraying. The applied film or coating 26 is between 0.001 and 0.040 inches thick, preferably between 0.002 and 0.006 inches thick with a porosity from 2 to 14 percent, preferably 7 to 9 percent. The surface roughness of the coating is in the range of from 100 to 4000 microinches, preferably 500 to 12500 microinches, depending on the material. The thermal conductive material can be any suitable material such as aluminum, carbon, ceramic, copper, tantalum, titanium, molybdenum, tungsten, silver, gold, platinum or stainless steel. FIG. 3 is a scanning electron micrograph of a conventional adsorbing surface taken at 6 KV with 100× magnification. FIG. 4 is a scanning electron micrograph of a condensing surface coated with a porous metal film of aluminum applied by twin arc spraying at the same magnification.

The porous or roughened surface structure such as that shown in FIGS. 2 and 4 provides several advantages. Since this is not a flat surface, incoming gas molecules collide with the surface features at various angles from 0 to 90 degrees. Because surface features are arranged at different angles, gas molecules can bounce off the surface features and back into the surface. This increases the chances that molecules will be trapped on the surface of the coating and frozen in place. Due to the porous and noncontinuous nature of the coating, molecules can be trapped between the surface features and collide repeatedly with the coating. Since the molecule is trapped, it collides with the surfaces until it loses sufficient energy that it is entrained by van der Walls forces at the pumping surface. There is also a vast increase in surface area without adding more pumping panels or baffle plates. The applied film is thermally conductive so that the low array temperatures are maintained at the surface of the array. Thus with the increased surface area presented by the applied film, both pumping speed and/or capacity are increased. Vacuum system performance is increased and the time between pump regeneration is increased.

Cryopump technology is frequently used as a means to evacuate semiconductor wafer fabrication process chambers. In order to test the efficacy of the invention described above a test was performed using standard wafer fabrication equipment. The test was performed using a Helix Technology CTI-CRYOGENICS On-Board 8F Cryopump on an Applied Materials Endura 5500 physical vapor deposition (sputtering) tool. The test was conducted on a chamber set-up to deposit Titanium Nitride (TiN).

Figure 5:
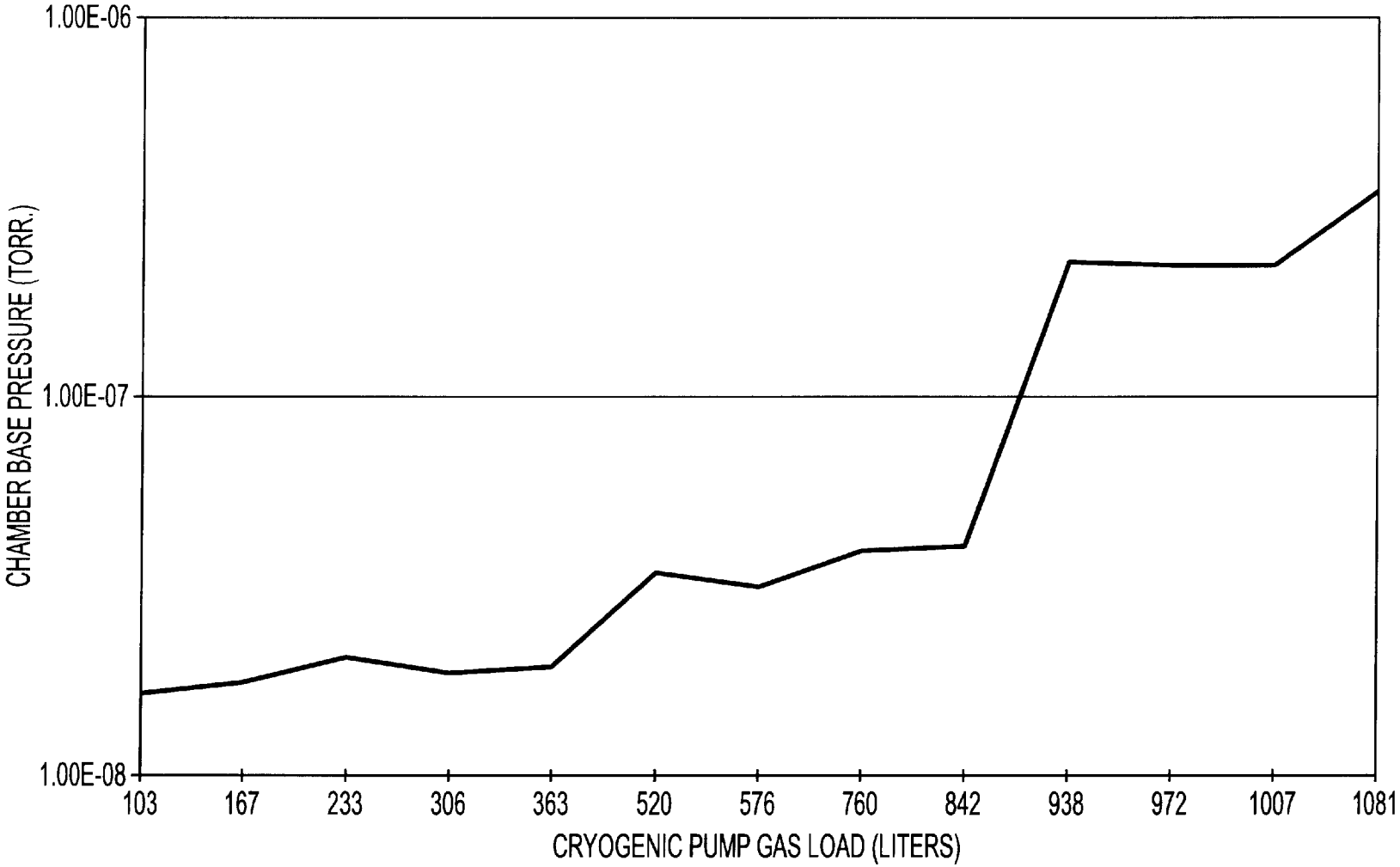
FIG. 5 shows the chamber base pressure as a function of cryogenic pump loading for a conventional pump.
Figure 6:
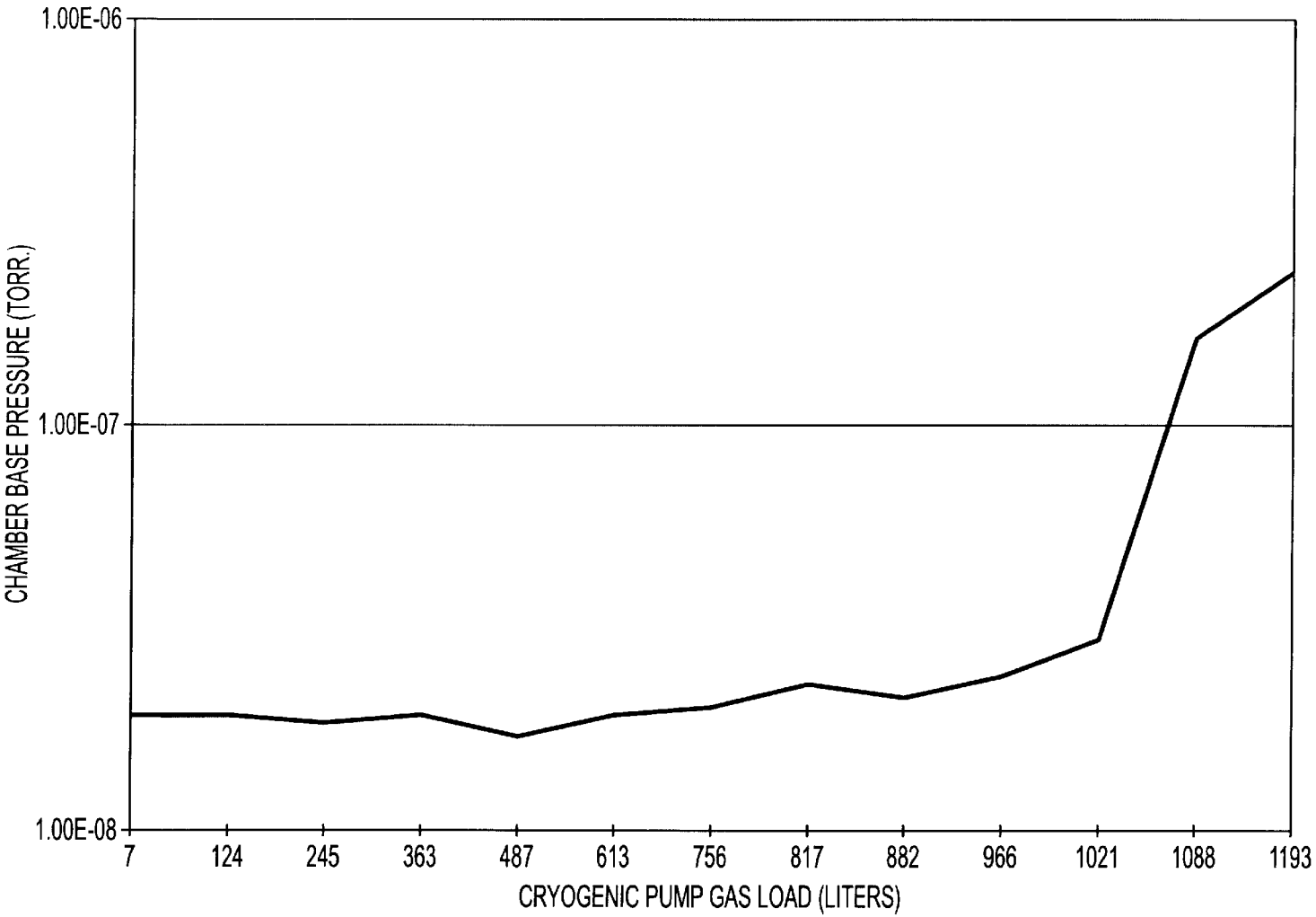
FIG. 6 shows the chamber base pressure as a function of cryogenic pump loading for a pump in accordance with the present invention.

FIG. 5 shows chamber base pressure (Torr) versus pump load (Liters) for a "standard" pump. The standard pump is an "as delivered" Helix Technology CTI OnBoard 8F. FIG. 6 shows the same pressure versus load curve for the same pump except that first stage array 21 was coated as per the invention described. The coating used for the curve in FIG. 6 was twin wire arc sprayed aluminum approximately 0.004 inches thick having a porosity about 8 percent. The surface roughness averaged 1000 microinches.

A comparison of the data suggests that the coated array allows the pump to operate at a lower base pressure for a longer period of time, thereby improving pump performance.

Although only results for coating the first stage are shown, it is clearly apparent that also coating the radiation shield 18 and/or the second stage array 23, and/or other internal cooled surfaces, would further improve pump performance.

The foregoing descriptions of specific embodiments of the present invention are presented for purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A condensing or adsorbing surface for cryopumps comprising a thermally conducting panel and a thermally conductive porous metal or ceramic coating or film applied on at least one surface of the panel to capture and condense gaseous molecules on the panel surface and the surface of the pores.

2. An adsorbing panel as in claim 1 in which the coating or film is between 0.001 and 0.040 inches thick.

3. An adsorbing panel as in claim 2 in which the porosity of the porous coating or film is between 2% and 14%.

4. An adsorbing panel as in claim 1 in which the coating or film is between 0.002 and 0.006 inches thick.

5. An adsorbing panel as in claim 4 in which the porosity of the porous coating or film is between 7% and 9%.

6. An adsorbing panel as in claims 1, 2, 3, 4 or 5 in which the coating or film is selected from a thermally conductive metal or ceramic.

7. A cryopump for pumping gaseous molecules by condensation and/or adsorption including thermally conducting members having at least one surface coated with a thermal conducting porous coating or film having a surface roughened between 100–4000 microinches for adsorbing or condensing gaseous molecules.

8. A cryopump as in claim 7 in which the porosity of the porous coating or film is between 2% and 14%.

9. A cryopump as in claim 7 in which the coating or film is between 0.002 and 0.006 inches thick.

10. A cryopump as in claim 9 in which the porosity of the porous coating or film is between 7% and 9%.

11. A cryopump as in claims 7, 8, 9 or 10 in which the coating or film is selected from a thermally conductive metal or ceramic.

12., A cryopump for pumping gaseous molecules by adsorption or condensation comprising a vacuum vessel and a refrigeration member in said vessel, a plurality of plates connected to said refrigeration member for adsorbing or condensing gaseous molecules characterized in that an applied thermally conducting porous or roughened coating or film having a surface roughened between 100–4000 microinches is carried on at least one surface of said plates to increase the surface area of said plates without materially increasing the dimensions of the plates.

13. A cryopump as in claim 12 in which the coating or film is between 0.001 and 0.040 inches thick.

14. A cryopump as in claim 13 in which the porosity of the porous coating or film is between 2% and 14%.

15. A cryopump as in claim 12 in which the coating or film is between 0.002 and 0.006 inches thick.

16. A cryopump as in claim 15 in which the porosity of the porous coating or film is between 7% and 9%.

17. A cryopump as in claims 12, 13, 14, 15 or 16 in which the coating or film is a thermally conducting metal or ceramic.

18. A condensing or adsorbing surface for cryopumps comprising a thermally conducting panel and a thermally conductive porous coating or film having a surface roughness in the range 100–4000 microinches applied on at least one surface of the panel to capture and condense gaseous molecules on the panel surface and the surface of the pores.

19. An adsorbing surface as in claim 1 in which the coating or film is between 0.001 and 0.040 inches thick.

20. An adsorbing surface as in claim 2 in which the porosity of the porous coating or film is between 2% and 14%.

21. An adsorbing surface as in claim 1 in which the coating or film is between 0.002 and 0.006 inches thick.

22. An adsorbing surface as in claim 4 in which the porosity of the porous coating or film is between 7% and 9%.

23. An adsorbing surface as in claims 1, 2, 3, 4 or 5 in which the coating or film is selected from a thermally conductive metal or ceramic.

24. An adsorbing surface as in claim 18 in which the surface roughness is between 500 and 1250 microinches.

* * * * *